US007666347B2

(12) United States Patent
Baekkedal et al.

(10) Patent No.: US 7,666,347 B2
(45) Date of Patent: Feb. 23, 2010

(54) MELTING APPARATUS AND METHOD

(75) Inventors: Dag Baekkedal, Tangen (NO); Jan August Bolstad, Stathelle (NO); Paul McGlade, Brisbane (AU); John Adrian Calvi, Melbourne (AU)

(73) Assignee: Advanced Magnesium Technologies Pty Ltd, Sydney (AU)

( * ) Notice: Subject to any disclaimer, the term of this patent is extended or adjusted under 35 U.S.C. 154(b) by 206 days.

(21) Appl. No.: 10/599,397

(22) PCT Filed: Mar. 30, 2005

(86) PCT No.: PCT/AU2005/000457

§ 371 (c)(1),
(2), (4) Date: Sep. 27, 2006

(87) PCT Pub. No.: WO2005/095026

PCT Pub. Date: Oct. 13, 2005

(65) Prior Publication Data

US 2008/0236338 A1 Oct. 2, 2008

(30) Foreign Application Priority Data

Mar. 30, 2004 (AU) ..... 2004901679

(51) Int. Cl.
*C22B 9/02* (2006.01)

(52) U.S. Cl. ..... 266/233; 266/234; 266/900

(58) Field of Classification Search ..... 266/233, 266/234, 900

See application file for complete search history.

(56) References Cited

U.S. PATENT DOCUMENTS

| | | | | |
|---|---|---|---|---|
| 1,993,972 | A * | 3/1935 | Marx | 126/343.5 R |
| 3,935,003 | A | 1/1976 | Steinke et al. | |
| 3,997,336 | A | 12/1976 | van Linden et al. | |
| 4,322,245 | A | 3/1982 | Claxton | |
| 4,572,485 | A | 2/1986 | Engelberg et al. | |
| 4,931,091 | A | 6/1990 | Waite et al. | |
| 5,064,174 | A * | 11/1991 | Lehto et al. | 266/160 |
| 5,908,488 | A | 6/1999 | Schröder et al. | |
| 5,984,999 | A | 11/1999 | Areaux | |
| 6,068,812 | A | 5/2000 | Areaux et al. | |
| 6,074,455 | A | 6/2000 | Van Linden et al. | |
| 2003/0197313 | A1 | 10/2003 | Areaux et al. | |

FOREIGN PATENT DOCUMENTS

| | | |
|---|---|---|
| CA | 2451735 | 6/2004 |
| EP | 0418481 | 3/1991 |
| EP | 1229250 A1 | 8/2002 |
| JP | 62099423 A | 5/1987 |

* cited by examiner

*Primary Examiner*—George Wyszomierski
*Assistant Examiner*—Tima M McGuthry-Banks
(74) *Attorney, Agent, or Firm*—Rodman & Rodman

(57) ABSTRACT

A melting apparatus facilitates the melting of pieces of solid metal in a bath of molten metal (10). The melting apparatus comprises a device (18) having a lower portion (22), an upper portion (20), and a body portion (24) extending therebetween. Solid metal is introduced into the device (18) through the upper portion (20). A flow inducer, such as an impeller (28) induces flow of molten metal through the device (18). Flow straighteners, such as baffles (38) encourage axial flow of molten metal through the device (18). The body portion (24) is formed with a plurality of apertures (36) therein and the device (18) is arranged, in use, with the lower portion (22) and the plurality of apertures (36) positioned within the bath (10) and the upper portion (20) positioned above the upper surface (12) and the molten metal bath (10).

9 Claims, 5 Drawing Sheets

MELTING APPARATUS AND METHOD

FIELD OF THE INVENTION

The present invention relates to methods and apparatus for melting pieces of solid metal in a bath of molten metal. The present invention has particular application, though not exclusive application, in relation to magnesium and magnesium alloys.

BACKGROUND TO THE INVENTION

The ease with which molten magnesium oxidises generally results in significant losses of metal during molten metal processing. This is particularly so for the overall process of high pressure die casting where there is generally a large amount of returns (eg. rejects, biscuits and runner systems) that need to be recycled. Typically, 40-60% of the weight of a casting requires recycling. The difficulty of recycling without large melt losses typically necessitates recycling in a dedicated facility.

Melt losses, and their consequences, add considerably to the cost of die castings because:

- up to 10% of purchased metal is lost to dross and sludge in some operations with the industry average for high pressure die casting being approximately 3-5%;
- the effect of melt loss is exacerbated each time metal is melted during recycling;
- dross and sludge cannot be readily recycled and therefore removal, transport, treatment and disposal of residues attract significant costs;
- of the increased risk of inclusions in the cast part with attendant higher scrap rates;
- of downtime of the melting furnace and the diecasting machine, and associated labour, to clean out accumulated sludge;
- of reduced furnace capacities due to accumulation of sludge; and
- due to its insulating effect, the presence of sludge reduces heat transfer from the heating medium to the molten magnesium, which results in poorer temperature control, extension of heating cycles and decreased crucible life due to increased temperatures at the crucible wall.

Dross is produced through reaction with air and moisture at the surface of the melt. The production of dross can be reduced by ensuring good seals at crucible lids, selection of an effective cover gas, good cover gas distribution to the melt surface, minimisation of melt surface area and reduction of disturbances to the melt surface.

Sludge mainly contains Fe—Mn—Al intermetallic compounds, oxides that have sunk rather than floated, and entrapped magnesium alloy. Intermetallics form because Fe dissolves from the crucible walls and reacts with Mn and Al in the melt. In this way Fe levels are kept low, but it is important to minimise this reaction otherwise sludge volumes and crucible maintenance increase and further additions of Mn may be necessary.

Intermetallics will also form if the temperature of the liquid falls below the equilibrium level set by the concentrations of Fe and Mn in solution in the liquid pool. This level will initially be set by the composition of the incoming metal, but will change with time in the crucible. Intermittent operation of a melting furnace will also lead to the formation of aluminium-rich compounds in the sludge. This in turn leads to increased dissolution of iron from the crucible.

The rate of dissolution of Fe increases with increasing temperature and the driving force for precipitation of intermetallics increases with decreasing temperature. Thus, if there are significant temperature differences in a melting furnace then large amounts of Fe will dissolve at hot spots on the crucible walls and this will result in the precipitation of intermetallics in cooler areas. Because melting involves the introduction of cold material to a melt, the situation in a melting furnace inherently involves hot and cold spots and so has the potential to generate large amounts of sludge.

An arrangement for melting which minimises the formation of dross and sludge would be of significant benefit to the magnesium industry, and particularly the magnesium die casting industry, because it would increase the efficiencies of melting operations and facilitate more efficient recycling of scrap.

SUMMARY OF THE INVENTION

In a first aspect, the present invention provides a method of melting pieces of solid metal in a bath of molten metal, the method comprising the steps of:

introducing the solid metal into a melting apparatus which is in fluid communication with the molten metal bath whilst maintaining the upper surface of the bath external to the melting apparatus substantially quiescent; and inducing flow of molten metal through the melting apparatus and over solid metal contained therein whilst maintaining the upper surface of the bath, both internal to and external to the melting apparatus, substantially quiescent.

Preferably, the pieces of solid metal are introduced into the melting apparatus with a view to minimal disturbance of the upper surface of the molten metal bath within the melting apparatus.

The flow of molten metal through the melting apparatus and over solid metal contained in the melting apparatus not only facilitates more rapid melting of the solid metal but also results in circulation of molten metal through the bath which reduces temperature variations within the bath. Preferably, the temperature variation within the bulk of the bath is less than ±5° C., more preferably less than ±2° C., most preferably less than ±1° C.

The flow of molten metal may be induced in a variety of ways including a pump or impellor located remotely from the melting apparatus. Preferably however, the flow of molten metal is induced by an impellor mounted within the melting apparatus.

The molten metal may be induced to flow through the melting apparatus in any direction but preferably, the flow is substantially vertically through the melting apparatus. The molten metal may be induced to flow downwardly through the melting apparatus but preferably the molten metal is induced to flow upwardly through the melting apparatus. The rate of flow may be varied during the melting process and the direction of flow may be reversed during the melting process.

In a second aspect, the present invention provides a melting apparatus for melting pieces of solid metal in a bath of molten metal, the melting apparatus comprising:

a device having a lower portion, an upper portion, and a body portion extending therebetween which is formed with a plurality of apertures therein, the device arranged, in use, with the lower portion and the plurality of apertures in the body portion positioned within the bath of molten metal and the upper portion positioned above the upper surface of the molten metal bath;

introduction means for introducing the solid metal into the device through the upper portion of the device;

flow inducing means for inducing flow of molten metal through the device; and flow straightening means for encouraging axial flow of molten metal through the device.

The flow inducing means may induce movement of molten metal in any direction through the device but preferably, the molten metal is induced to move substantially vertically through the device. The molten metal may be induced to flow upwardly through the device with the molten metal entering the device through the lower portion and exiting the device through the apertures. Alternatively, the molten metal may be induced to flow downwardly through the device with the molten metal entering the device through the apertures and exiting the device through the lower portion.

The flow inducing means may take the form of an impellor mounted within the device in which case the flow straightening means preferably takes the form of baffles in a grid arrangement which encourages axial flow of the molten metal by minimising the radial component of the flow induced by the impellor and thereby minimises the tendency for a vortex to form at the surface of the molten metal within the device. The height of the baffles in the direction of flow is preferably much greater than the width of each baffle forming the grid. Preferably one baffle grid is located above the impellor and another baffle grid below the impellor.

Preferably, the plurality of apertures are formed in a band which extends substantially around the body portion.

The melting apparatus may be of any shape but the body portion is preferably circular in cross-section.

Preferably, the melting apparatus further comprises flow diversion means for directing molten metal exiting the body through the apertures away from the upper surface of the molten metal bath. The flow diversion means may take the form of a collar or skirt which projects from the body from a level above the apertures. Preferably, the collar/skirt surrounds the device projects outwardly and downwardly from the body.

At least preferred embodiments of the present invention enable:

- rapid melting of solid metal in the flow of molten metal within the melting apparatus;
- efficient circulation of molten metal which minimises temperature fluctuations in the bath as a whole;
- maintenance of a quiescent melt surface outside the melting apparatus;
- minimal disturbance of the melt surface within the melting apparatus when new solid metal is introduced;
- suspension of particulate impurities entering the melt so that they do not accumulate in the bath and hence can be removed in a subsequent settling furnace;
- improved heat transfer between the crucible wall and the molten metal;
- prevention of the accumulation of cold liquid around the melting solid; and
- prevention of the accumulation of cold liquid at any other point in the bath.

Use of the present invention in combination with good seals and cover gas technology can result in very low rates of dross and sludge production and at least preferred embodiments of the present invention facilitate an approximate doubling of the rate at which metal can be melted in a conventional melting furnace.

The present invention may be used in a recycling or refining operation where a salt flux is used to assist in separation of non-metallics from the molten metal.

BRIEF DESCRIPTION OF DRAWINGS

Preferred embodiments of the present invention will now be described, by way of example only, with reference to the accompanying drawings, in which.

DRAWING RELATED DESCRIPTION

Figure 1:
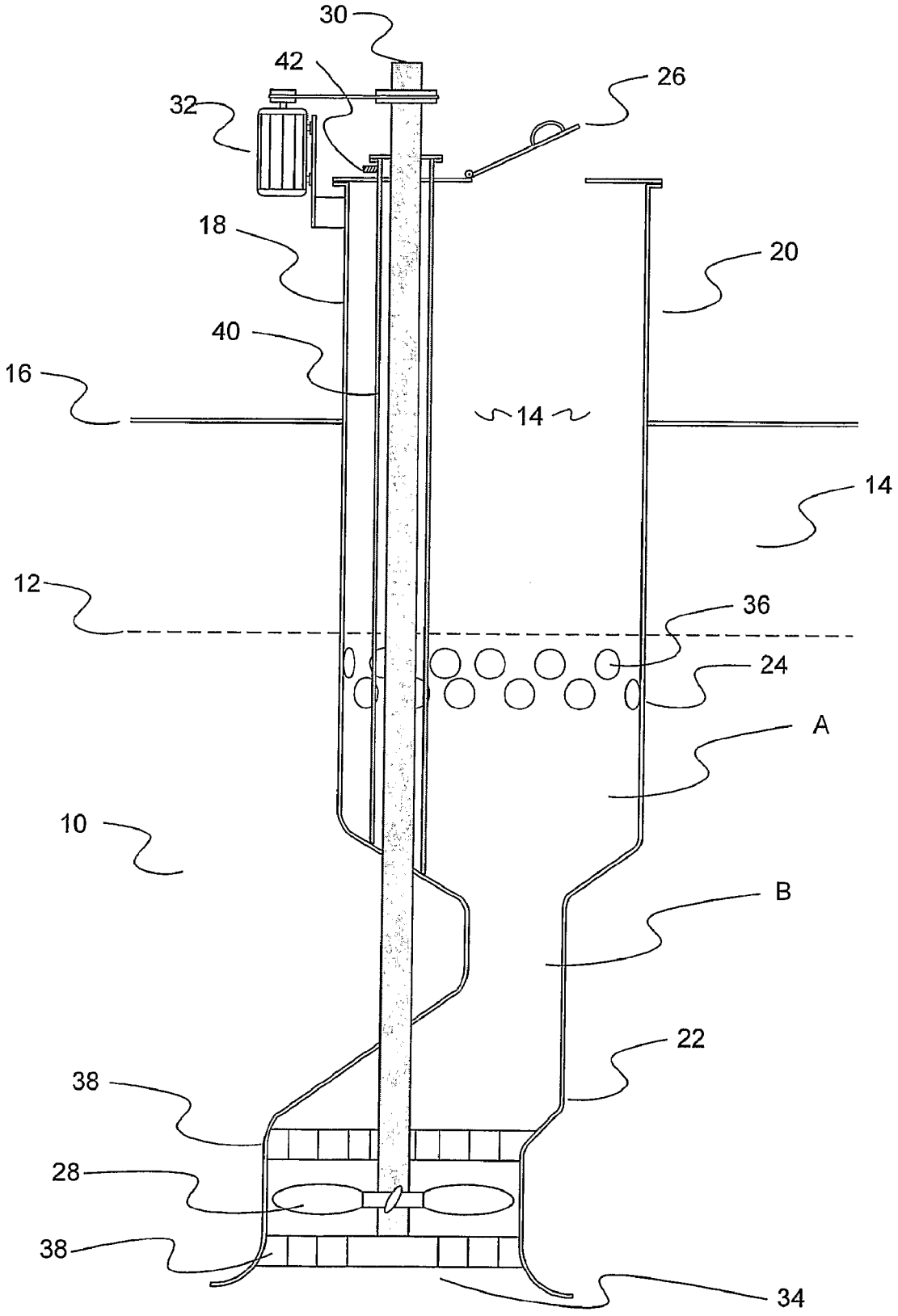
FIG. 1 is a side elevation of a melting apparatus according to the present invention.

Referring initially to FIG. 1, a bath of liquid metal 10 having an upper surface 12 is contained by a crucible (not shown) in a furnace (not shown). A gas space 14 is formed between a furnace lid 16 and the liquid metal level 12. In the case where a reactive metal such as magnesium is being contained the gas space 14 will be occupied by a protective cover gas atmosphere; the composition of which will be known to practitioners of the art. In situations where a flux is being used for a recycling or refining operation the surface of the molten metal will be covered by a layer of flux. In this situation a protective cover gas atmosphere may or may not be contained in the gas space 14. In the case of more inert metals being contained no special atmosphere will be required.

Figure 2:
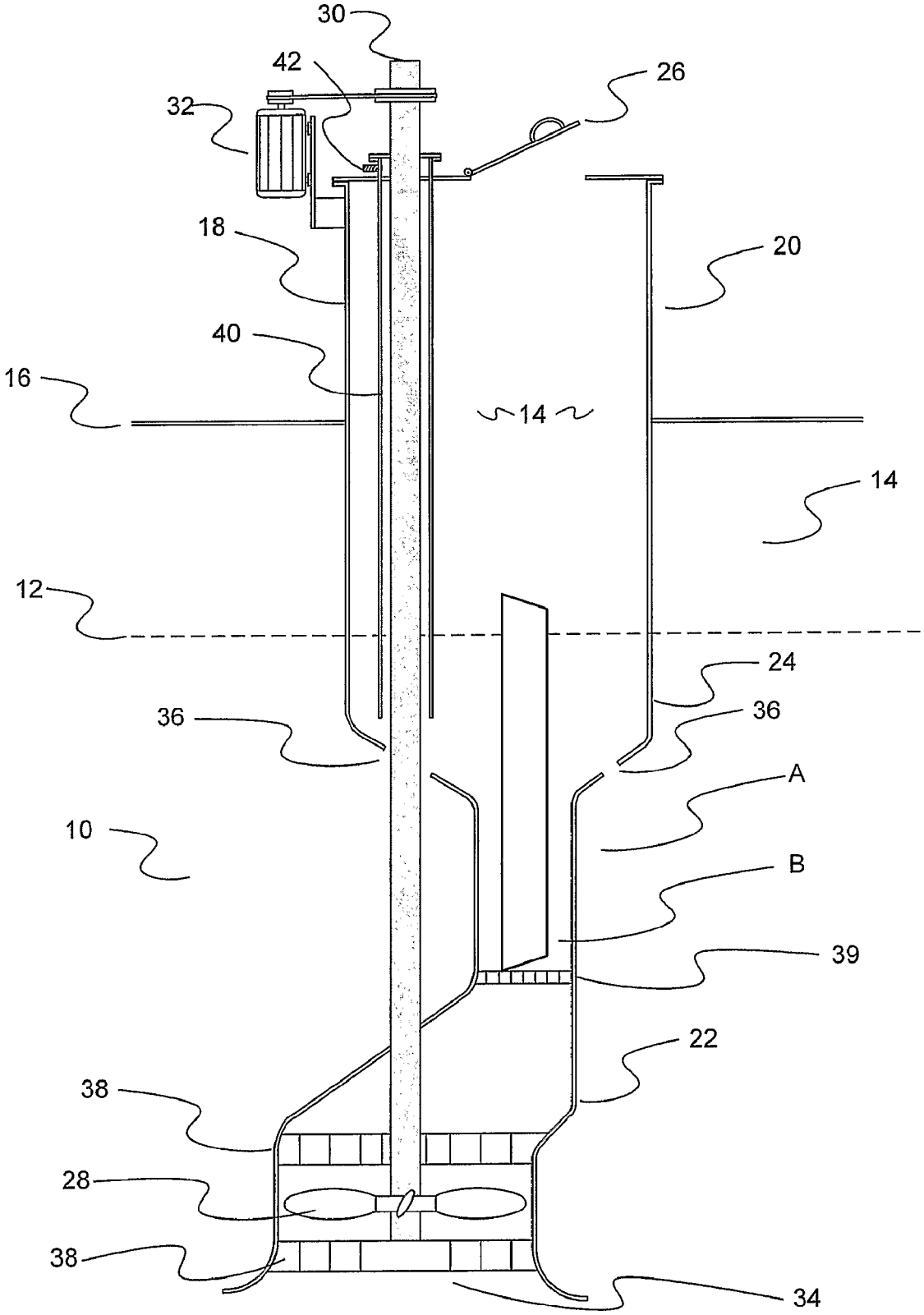
FIG. 2 is a side elevation of an alternative embodiment of the melting apparatus of FIG. 1.

The melting apparatus generally comprises a device 18 having an upper portion 20, a lower portion 22, and a body portion 24 which extends between the upper portion 20 and lower portion 22. The upper portion 20 is formed with introduction means in the form of a lid 26 for introducing solid metal into the device 18. Flow of molten metal upwardly through the device 18 is induced by rotation of impellor 28 which is mounted on drive shaft 30 which is driven by variable speed motor 32. Motor 32 may be of any form but will typically be electrically or pneumatically driven. Molten metal is drawn into the device 18 through entry port 34 in lower portion 22, flows upwardly through the device 18, and exits through apertures 36 in body portion 24. The apertures 36 may be of any shape and may take the form of slots. A different form of apertures 36 is illustrated in FIG. 2.

The melting apparatus has two flow straightening baffles in the form of grids 38; one above the impellor 28 and one below the impellor 28. The baffle grids 38 encourage axial flow of the molten metal by minimising the radial component of the flow and thereby minimise the tendency for a vortex to form at the surface 12 of the molten metal within the device 18. The baffle grids 38 also increase the effectiveness of the pumping action of the impellor 28.

The apertures 36 are positioned below the liquid surface 12 to ensure the liquid returning to the bath 10 does so with minimal disturbance of the liquid surface 12.

When the melting apparatus is operated so as to direct the flow of liquid down through the device 18, the apertures 36 become liquid metal entry points and port 34 becomes the liquid exit point.

Solid material is introduced into the upper portion 20 of the apparatus through lid 26. The method of introduction of the solid is dependent on the form and shape of the solid pieces. Large scale solid pieces are desirably introduced into the liquid in a controlled fashion to minimise splashing. A robotic arm or similar mechanical device specifically designed to feed the solid pieces into the device 18 in a controlled fashion may be utilised.

On entering the liquid metal the circulation of the liquid over the solid promotes the rapid melting of the solid. In the case of lighter pieces of solid the melting will typically take place below the liquid surface 12 in the general area of the region marked A. The flow of liquid over the solid pieces provides a zone of accelerated melting. In the case of larger pieces such as ingots melting will typically take place in the region of reduced cross-sectional area marked B. The reduced cross-section provides a zone of higher velocity liquid metal around the solid metal which improves the heat transfer rate from the liquid to the solid thus reducing the time taken to melt the solid. For larger pieces the apparatus may include a screen 39 (see FIG. 2) for supporting the pieces during melting.

A protective tube 40 surrounds the impellor drive shaft 30. The tube 40 helps prevent the formation of a vortex around the rotating shaft 30 that might otherwise lead to the entrapment of metallic oxides within the bath. The tube 40 also acts to prevent damage to the drive shaft 30 during the introduction of heavier solid pieces into the apparatus. An inert gas, such as argon, or a protective gas may be introduced into the tube 40 through a valve 42 to help prevent a significant build up of oxide at the liquid surface 12 where the drive shaft 30 enters the liquid bath 10 and thus reduce the tendency for clogging or jamming of the rotating shaft.

Figure 3:
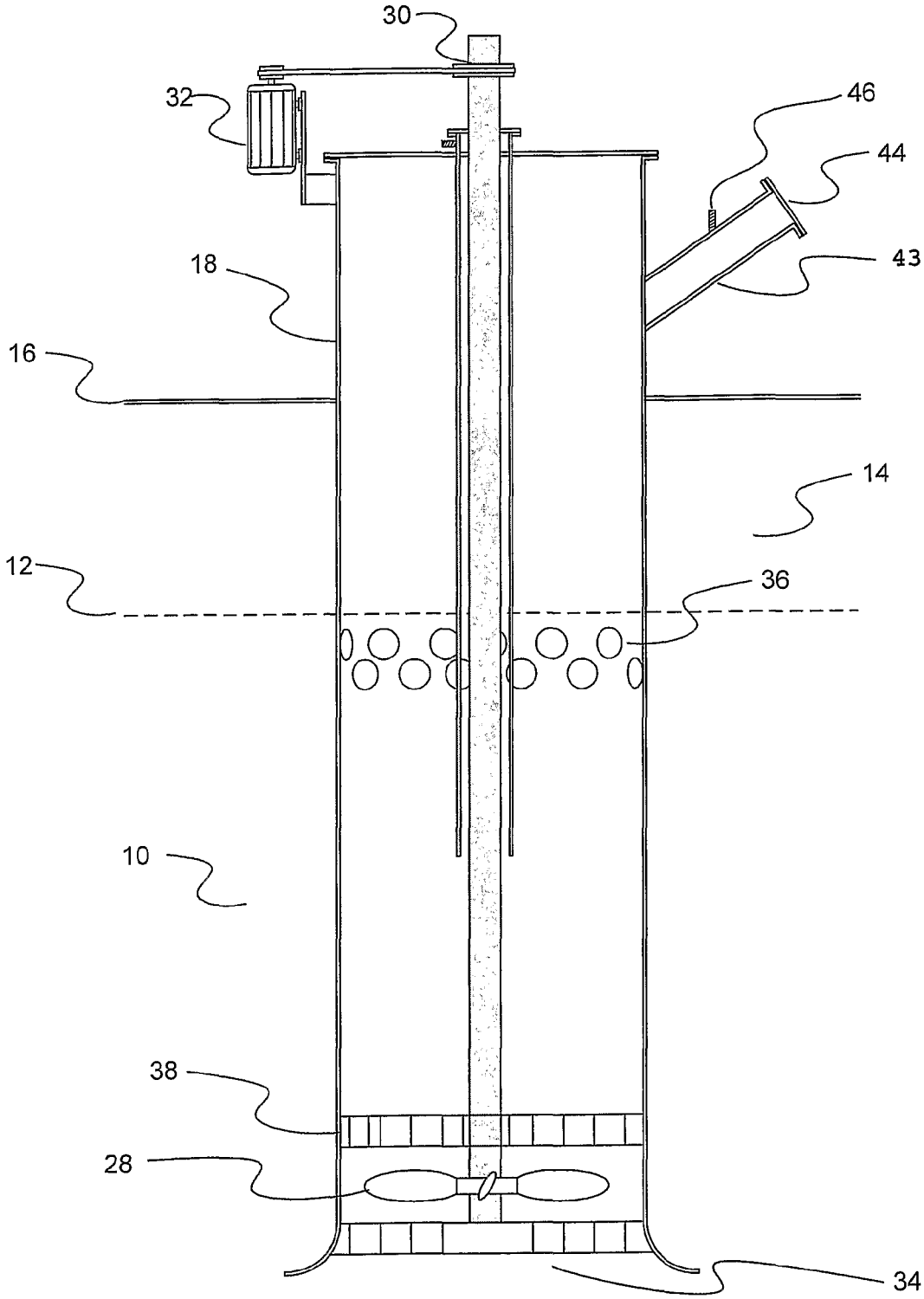
FIG. 3 is a side elevation of an alternative embodiment of the melting apparatus of FIG. 1, tailored to suit a feed of small scale pieces such as shredded material or chips.

In the case where only small scale solid pieces are to be handled, the melting apparatus of the present invention can be simplified to that illustrated in FIG. 3 in which like reference numerals are utilised to FIG. 1. The small scale solid pieces would typically be produced by a shredding or chipping operation.

The solid pieces are fed into the apparatus through an access port 43 after opening a removable cover 44 using any desired type of materials handling equipment. The supply of the solid pieces would be regulated to match the heat input rate of the furnace, the melting rate of the solid pieces and the rate of liquid removal from the furnace. Protective atmosphere, if required, may be introduced via valve 46 into the access port 43 to help maintain the desired protective atmosphere above the liquid metal bath which would otherwise be diluted or disturbed by the opening of the cover 44 and the introduction of the solid pieces.

The simplified design of the embodiment of FIG. 3 facilitates removal of the internal structures of the melting apparatus, such as the drive shaft and the impellor, without the need to completely dismantle or remove the apparatus from its installed position in the furnace. Suitable apertures can be made in the upper baffle grid 38 to allow withdrawal of the impellor.

Figure 4:
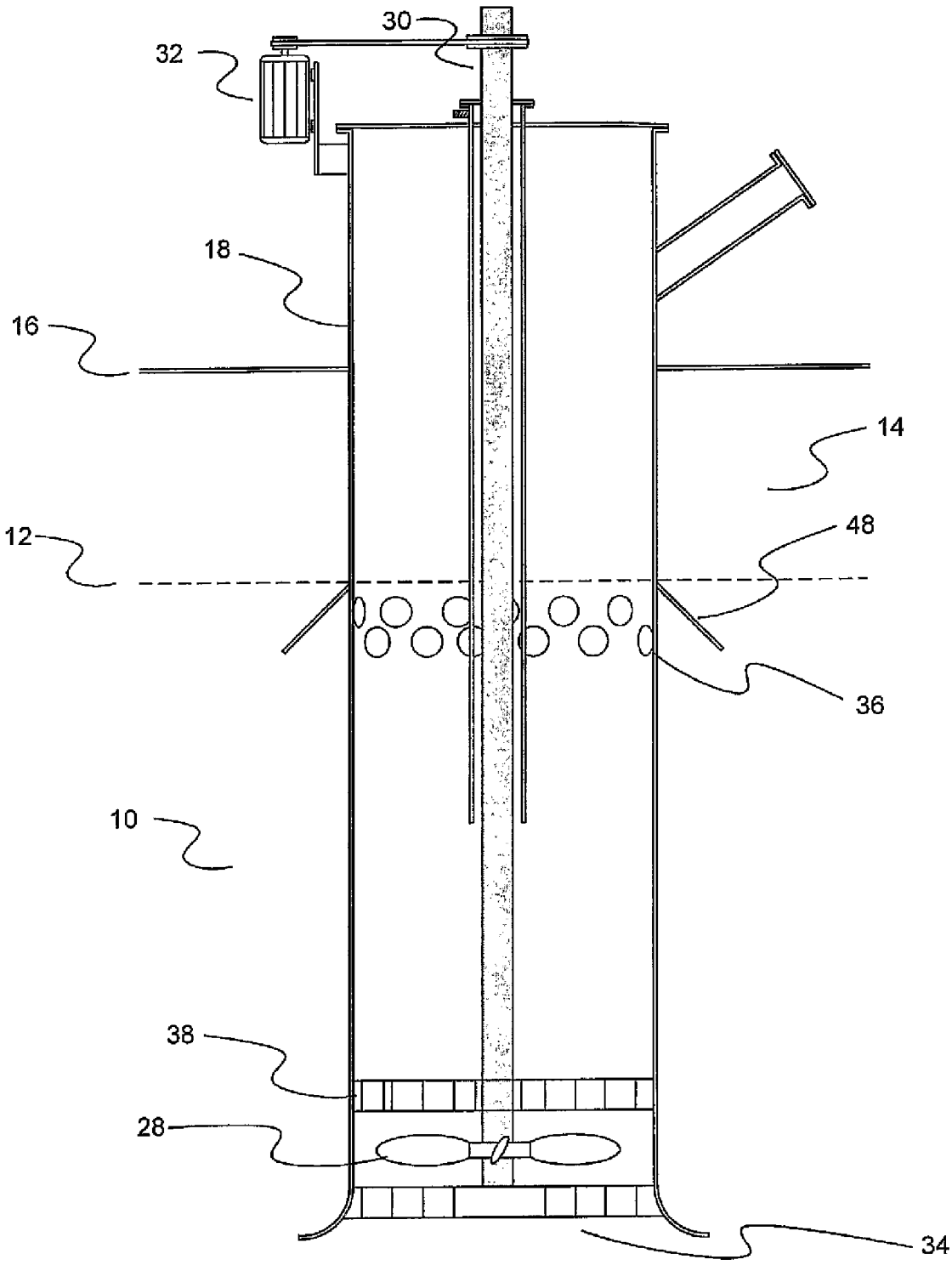
FIG. 4 is a side elevation of the melting apparatus of FIG. 3 with the addition of flow enhancing directional skirts.

FIG. 4 is an embodiment equivalent to FIG. 3 but which features a flow diversion device in the form of skirt 48 which minimises disturbance of the surface 12 as molten metal exits apertures 36. The skirt 48 directs the flow of liquid down into the liquid bath 10 away from the liquid surface 12. It will be appreciated that a skirt 48 could be equally employed with the embodiments of FIG. 1 or FIG. 2.

Figure 5:
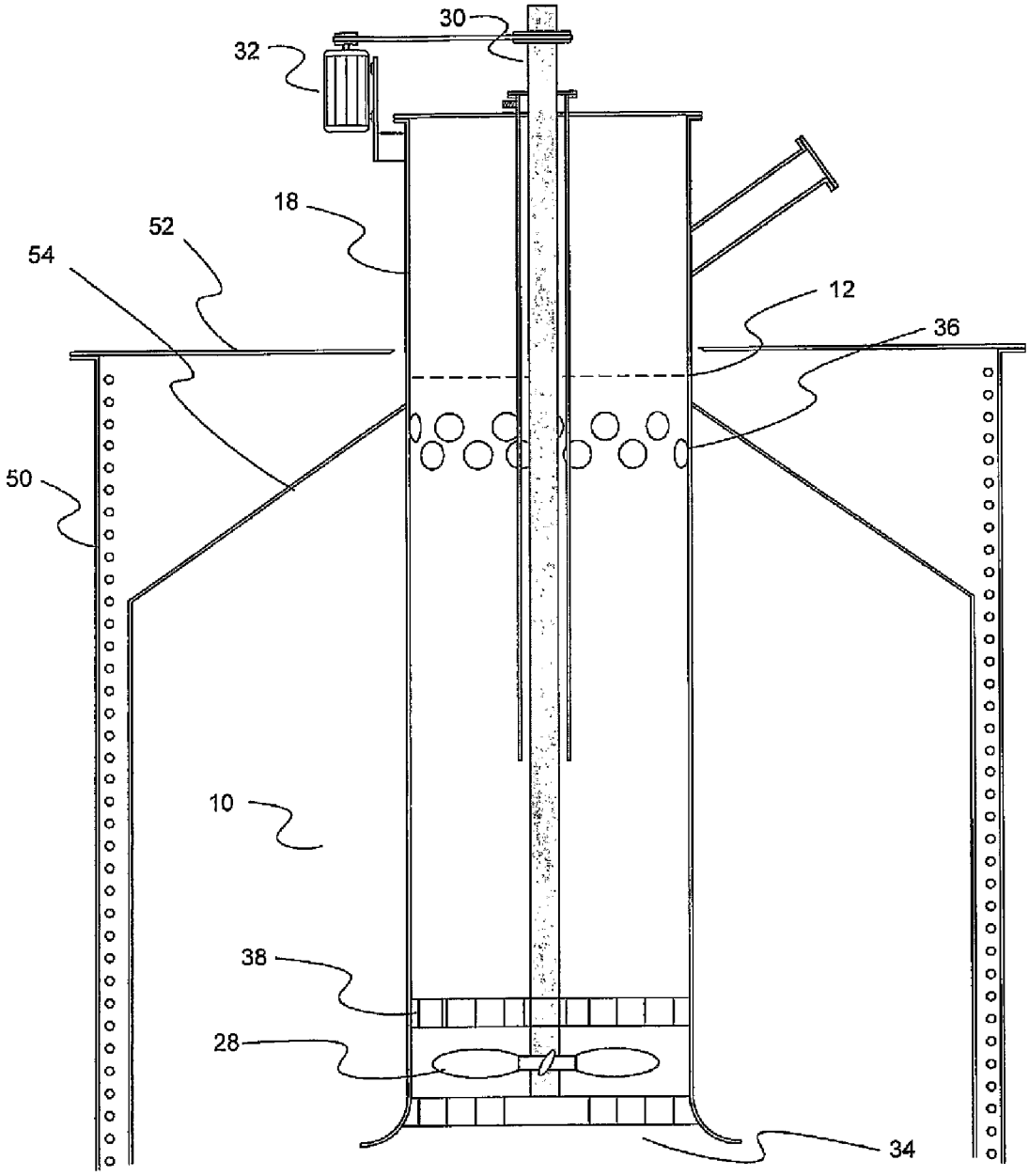
FIG. 5 is a side elevation of the melting apparatus of FIG. 3 in a configuration where the extent of free liquid metal surface is minimised.

FIG. 5 is also an embodiment equivalent to FIG. 3. In the embodiment of FIG. 5 the gas space above the molten liquid bath externally of the device 18 is removed altogether. The removal of the gas space could be achieved equally well in the embodiments of FIG. 1 or FIG. 2. In the embodiment of FIG. 5, the skirt 48 shown in FIG. 4 is effectively extended to connect with and join the crucible walls. The furnace 50 and furnace cover 52 are arranged to accommodate a crucible with closed-in top 54. The liquid contained in the crucible completely fills the vessel thereby removing the need for a gas space above the liquid surface externally of the device 18. The movement of liquid and general operation of this embodiment of the present invention occurs in the manner previously described with the added benefit of eliminating the possibility of disturbing the liquid surface and entraining any oxides or surface contaminates into the bulk of the bath.

In the embodiment of FIG. 5, apertures 36 are positioned close to the point where the crucible lid 54 joins the device 18 to avoid the formation of a gas pocket and the entrainment of the entrapped gas into the bulk of the bath under the action of the apparatus. In use, the liquid level 12 inside the device 18 would be maintained above the level where the crucible lid 54 joins the device 18 to similarly avoid formation of a gas pocket.

EXAMPLES

Example 1

A melting apparatus as illustrated in FIG. 2 was installed in a 220 kW furnace and a crucible having a capacity of 1.4 tonnes of molten magnesium. The melting apparatus had a diameter of 275 mm at the surface 12 of the molten metal in the crucible. The diameter of the melting apparatus reduced to 160 mm at the reduced cross-sectional region B.

Tests were conducted to measure the time required for 8 kg and 12 kg ingots of magnesium alloy AZ91 to melt using different upward flow speeds of molten metal, at approximately 700° C., through the apparatus. The different upward flow speeds of molten metal were generated by operating the impellor 28 at different rotational speeds (0 rpm, 100 rpm, 200 rpm and 300 rpm). The times for the ingots to be completely melted are set out in Table 1 below, together with the corresponding melting capacities of the apparatus.

TABLE 1

Melting Time of AZ91 Ingots at Various Flow Rates

| Ingot Weight (kg) | Impellor Speed (rpm) | Melting Time (s) | Melting Capacity (t/h) |
|---|---|---|---|
| 12 | 0 | 75 | 0.6 |
| 12 | 200 | 35 | 1.2 |
| 12 | 300 | 25 | 1.7 |
| 8 | 100 | 50 | 0.5 |
| 8 | 200 | 30 | 1.0 |
| 8 | 300 | 20 | 1.5 |

From Table 1 it can be seen that the time to melt an ingot is substantially reduced with increasing impellor speed and hence increasing flow rate of molten metal through the apparatus and over the ingot.

Example 2

The melting apparatus of Example 1 was installed in a combined melting and dosing furnace providing molten magnesium alloy AZ91 to a high pressure die casting machine. The furnace rating was 250 kW and a crucible with a capacity of 3.5 tonnes of molten magnesium was used. The die casting machine produced castings requiring a 12 kg shot weight. The melting apparatus was operated continuously for a period of 10 days, melting 8 kg ingots at the rate required to keep the metal level 12 in the crucible approximately constant. The impellor 28 was operated at between 200 and 300 rpm.

During this period, 2,558 castings were made involving a total throughput of approximately 30.7 tonnes of magnesium alloy. Operation of the furnace and high pressure die casting machine with the melting apparatus was found to have the following benefits compared to conventional operation, ie. when the apparatus is not installed and ingots are fed directly into the molten metal in the furnace crucible:

- the melt loss due to dross and sludge produced as a weight % of the total input of metal to the furnace was reduced from approximately 2.4 weight % to less than 1 weight %;
- the up time for the die casting machine, ie. the proportion of available time when the die casting machine was operational and not stopped due to operational difficulties such as metal pump disruption, variable shot volumes, and melt cleaning, increased from 90% to 95%;

the number of faulty castings determined on the basis of a requirement for pressure tightness was reduced by 30%;

cover gas consumption was reduced; and less maintenance was required.

Example 3

A melting apparatus as illustrated in FIG. 2 was installed in a combined melting and dosing furnace providing molten magnesium alloy AM-60 to a high pressure die casting machine. The melting apparatus had a diameter of 460 mm at the surface 12 of the molten metal in the crucible. The diameter of the melting apparatus reduced to 160 mm in the reduced cross-sectional region B. The furnace rating was 250 kW and a crucible with a capacity of 1.8 tonnes of molten magnesium was used. The die casting machine produced castings requiring a 7 kg shot weight of which 3 kg was the part weight. Feed to the melting apparatus was in the form of 8 kg ingots, plus process returns of biscuits, gates and runners (approximately 4 kg per casting) and occasional reject castings. The feed thus comprised approximately 43% ingots and 57% returns. The equipment was operated intermittently with a total of 180 tonnes of alloy (ingots plus returns) being melted and cast. During operation, the melt temperature was approximately 690° C. and the impellor speed approximately 180 rpm.

In conventional equipment it was found to be not possible to satisfactorily recycle process scrap of biscuits, gates, runners and reject castings in the feed to the melting and dosing furnace without significantly increasing melt losses and substantially reducing the quality and performance of the castings. However, using the melting apparatus of the present invention it was found that process scrap could be included in the feed without the resulting difficulties faced by conventional equipment occurring.

A control run was performed using this apparatus to determine the effect on melt loss of using process scraps in the feed. It was found that with 50% process scraps (ie. biscuits, gates, runners and reject castings), the melt loss was approximately 1.5 weight % of the total input of metal to the furnace. This compared favourably to operation with a pure ingot feed, which had a less than 1 weight % melt loss.

Example 4

A melting apparatus of the kind illustrated in FIG. 2 was installed in a combined melting and dosing furnace providing molten magnesium alloy AM-60 to a high pressure die casting machine. In this case, the melting apparatus had a 180 mm by 180 mm square cross-section at the surface 12 of the molten metal level in a crucible. The melting apparatus reduced to a 140 mm 120 mm rectangular cross-section at the reduced cross-sectional region B.

The available melting rate of the furnace was 120 kg/hour and the crucible had a capacity of 0.4 tonnes of molten magnesium. The die casting machine produced castings requiring a 2.4 kg shot weight at 60 shots per hour. Feed to the apparatus was in the form of 8 kg ingots. The equipment was operated continuously for three weeks in a three shift operation. During operation the impellor 28 speed was approximately 200 rpm with an idle speed of 50 rpm.

During the period in which the apparatus was in operation, the melting rate of the feed increased by 25% to approximately 150 kg/hour and the production of sludge in the furnace was reduced by 80% compared to conventional operation. The melt loss was found to be less than 1 weight % of the total input of metal to the furnace.

In the preceding description of the invention and in the claims which follow, except where the context requires otherwise due to express language or necessary implication, the word "comprise" or variations such as "comprises" or "comprising" is used in an inclusive sense, ie. to specify the presence of the stated features but not to preclude the presence or addition of further features in various embodiments of the invention.

The invention claimed is:

1. A melting apparatus for melting pieces of solid metal in a bath of molten metal, the melting apparatus comprising:

a device having a lower portion, an upper portion, and a body portion extending therebetween which is formed with a plurality of apertures therein, the device arranged, in use, with the lower portion and the plurality of apertures in the body portion positioned within the bath of molten metal and the upper portion positioned above the upper surface of the molten metal bath;

introduction means for introducing the solid metal into the device through the upper portion of the device;

flow inducing means for inducing flow of molten metal through the device, positioned within the bath of molten metal; and flow straightening means for encouraging axial flow of molten metal through the device, comprising a plurality of baffles arranged in at least one grid and positioned within the device below the plurality of apertures.

2. A melting apparatus as claimed in claim 1 wherein a first grid is located above the flow inducing means and a second grid is located below the flow inducing means.

3. A melting apparatus as claimed in claim 1 further comprising flow rate varying means for varying the flow rate of molten metal through the device.

4. A melting apparatus as claimed in claim 3 wherein the flow rate varying means comprises a variable speed drive for the flow inducing means.

5. A melting apparatus as claimed in claim 1 wherein the flow inducing means comprises an impellor.

6. A melting apparatus as claimed in claim 5, further comprising support means for supporting pieces of solid metal in the device during melting.

7. A melting apparatus as claimed in claim 5, further comprising flow diversion means for directing molten metal exiting the body through the apertures away from the upper surface of the molten metal bath.

8. A melting apparatus as claimed in claim 7 wherein the flow diversion means comprises a collar or skirt which projects from the body from a level above the apertures.

9. A melting apparatus as claimed in claim 8 wherein the collar/skirt surrounds the device and projects outwardly and downwardly from the body.

* * * * *